United States Patent [19]

Bartlow et al.

[11] 4,159,781

[45] Jul. 3, 1979

[54] GLASS FIBER REINFORCED THERMOSETTING RESIN TANK FOR PROCESSING OLIVES

[75] Inventors: David H. Bartlow, Conroe, Tex.; Robert M. Sommerkamp, Mt. Union, Pa.

[73] Assignee: Owens-Corning Fiberglas Corporation, Toledo, Ohio

[21] Appl. No.: 922,946

[22] Filed: Jul. 10, 1978

[51] Int. Cl.[2] ..... B65D 7/02; B65D 7/00

[52] U.S. Cl. ..... 220/5 A; 220/4 B; 99/535; 220/20.5

[58] Field of Search ..... 220/5 A, 5 R, 4 B, 4 E, 220/1 B, 20.5, 22; 99/535, 536

[56] References Cited

U.S. PATENT DOCUMENTS

| | | | |
|---|---|---|---|
| 672,994 | 4/1901 | Wacker | 99/535 |
| 2,832,496 | 4/1958 | Williams | 220/5 R |
| 3,934,747 | 1/1976 | Needt | 220/5 R |
| 4,036,390 | 7/1977 | Morse | 220/1 B X |
| 4,092,519 | 5/1978 | Eaton-Williams | 220/4 E X |

*Primary Examiner*—William Price
*Assistant Examiner*—Steven M. Pollard
*Attorney, Agent, or Firm*—Ronald C. Hudgens; Patrick P. Pacella; Paul J. Rose

[57] ABSTRACT

An upper tank half provided with a manway and a lower tank half provided with a sump are each formed of thermosetting resin reinforced with chopped glass fiber strands and then secured together with several plys of resin-impregnated glass mat applied around the circumference at the joint inside and outside of the tank. Each tank half is flared adjacent the joint to provide half of a tank strengthening rib for the completed tank, which has a diameter larger than its height. Two semi-circular perforated olive retaining plates are removably mounted in the upper tank half adjacent the lower end of the manway. Aboveground and underground embodiments of the tank are provided.

8 Claims, 6 Drawing Figures

GLASS FIBER REINFORCED THERMOSETTING RESIN TANK FOR PROCESSING OLIVES

This invention relates generally to glass fiber reinforced resin tanks, and more particularly to such tanks for processing olives in brine.

An object of the invention is to provide a glass fiber reinforced resin tank for storing and processing olives.

Another object is to provide a tank for processing olives, the tank having a manway and improved removably mountable retaining means preventing olives from floating above the lower end of the manway.

A further object is to provide a glass fiber reinforced resin tank formed of two halves, each half being flared outwardly adjacent the joint with the other half to provide half of a strengthening rib for the tank.

Still another object is to provide a glass fiber reinforced resin tank formed of two halves, each half including a hollow generally cylindrical portion and another portion forming the top or bottom of the tank and being mainly a hollow spherical segment, the axial length of the cylindrical portion being not substantially greater than the height or depth of the spherical segment and the overall height of the tank being substantially less than the diameter.

Other objects and advantages will become apparent when the following specification is considered along with the accompanying drawings in which.

Figure 2:
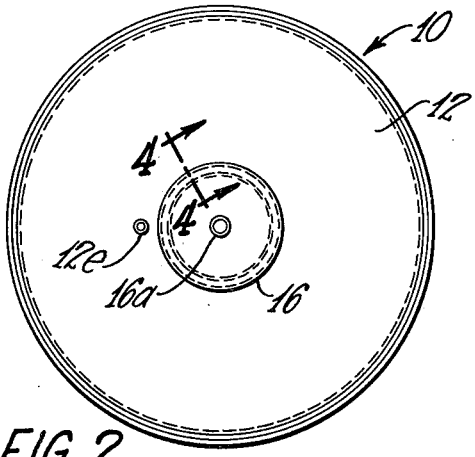
FIG. 2 is a plan view of the tank of FIG. 1.
Figure 1:
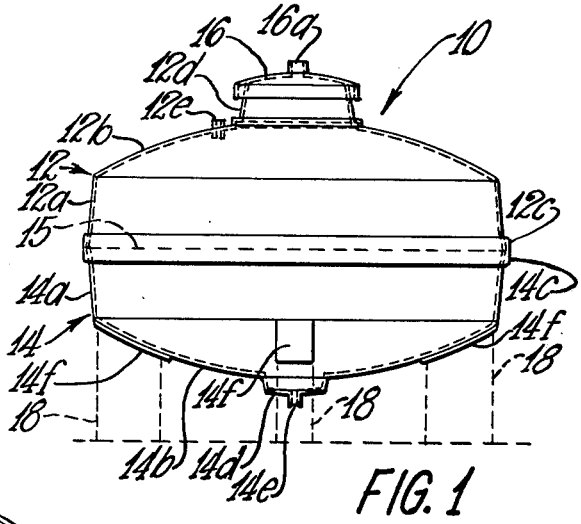
FIG. 1 is an elevational view of a tank constructed in accordance with the invention.
Figure 3:
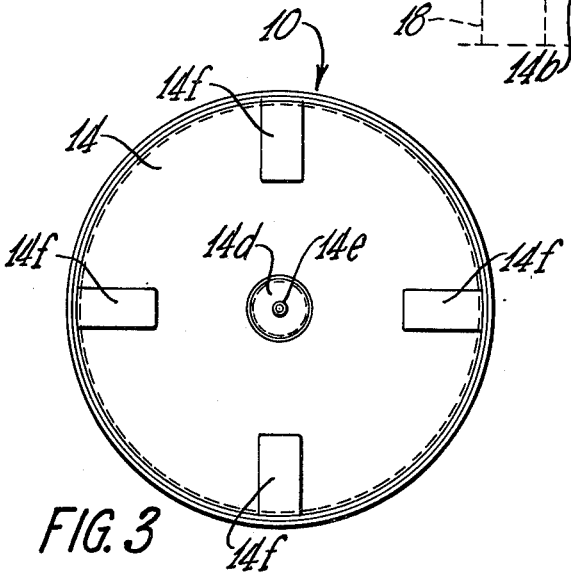
FIG. 3 is a bottom view of the tank of FIG. 1.

With respect to the drawings, FIGS. 1–3 show a tank 10 constructed in accordance with the invention. The tank 10 includes an upper tank half 12 and a lower tank half 14 made of chopped glass fiber strand reinforced thermosetting resin and each including a hollow generally cylindrical portion (12*a*, 14*a*) and a hollow generally spherical portion or segment (12*b*, 14*b*). Each of the generally cylindrical portions 12*a* and 14*a* is joined to the other along a junction line 15, being flared out adjacent the joint and the two flared portions 12*c* and 14*c* together constituting a strengthening rib for the tank 10. The joining is accomplished by laying several strips of resin-impregnated glass mat around the circumference both inside and outside the tank and across the junction line 15, and curing the resin.

The spherical portion 12*b* is provided with an upwardly convergent frustoconical manway 12*d* and a pipe coupling 12*e* and the spherical portion 14*b* is provided with a sump 14*d*. A domed cover 16 is provided for the manway 12*d* and has a sleeve 16*a* for guiding a float rod (not shown).

When the tank 10 is intended for use above ground, a drain fitting 14*e* is provided in the sump 14*d* and four equally spaced built-up bearing portions 14*f* of resin-impregnated glass mat are provided on the spherical portion 14*b* for engagement with concrete mounting cradles 18 shown in broken lines in FIG. 1. For underground use, the drain fitting 14*e* and the bearing portions 14*f* are omitted.

Figure 4:
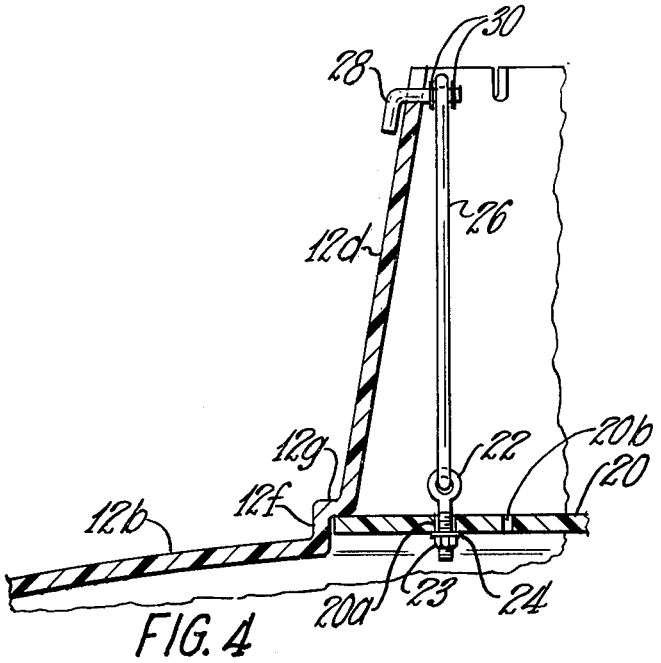
FIG. 4 is an enlarged fragmentary sectional view of an upper portion of the tank taken generally along the line 4—4 of FIG. 2 and omitting a cover for a manway.
Figure 6:
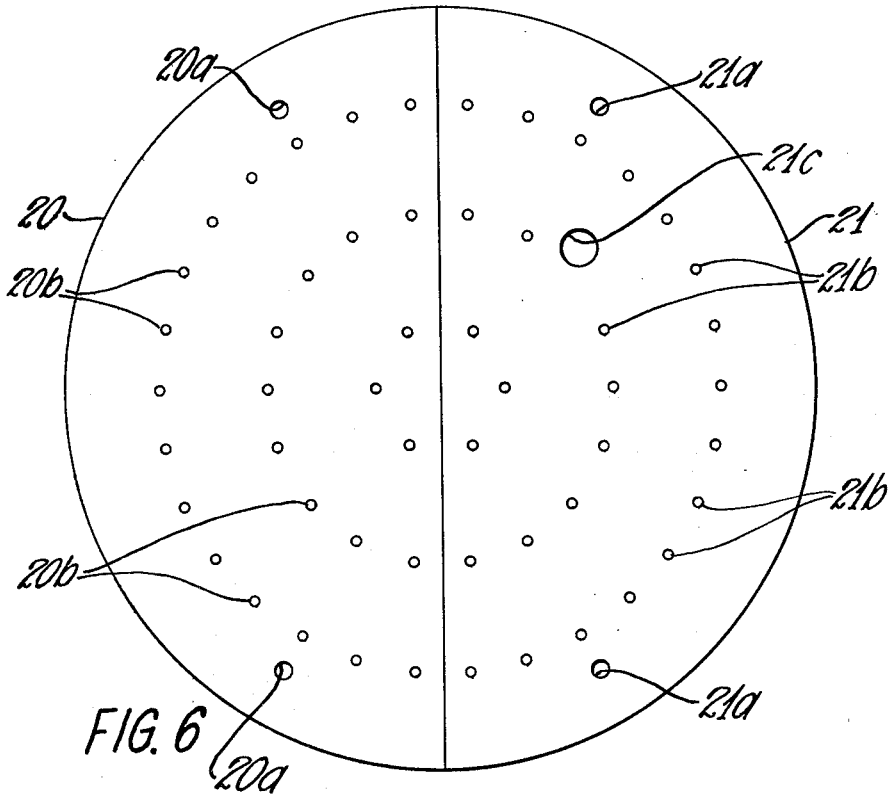
FIG. 6 is a plan view of two semicircular olive retaining plates, one of which is fragmentarily shown in FIG. 4.

As shown in FIG. 4, the junction of the manway 12*d* and the spherical portion 12*b* includes a sleeve portion 12*f* and a shoulder portion 12*g* forming a partial housing for a pair of removably mountable semicircular perforated retaining plates 20 and 21 best shown in FIG. 6.

Figure 5:
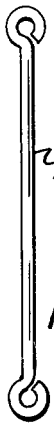
FIG. 5 is an elevational view of a holding link for an olive retaining plate, taken from the right-hand side of its showing in FIG. 4.

The plate 20 is provided with a pair of holes 20*a* each of which has an eyebolt 22 secured therein by a nut 23 provided with a washer 24. Each eyebolt 22 is connected by a loop-ended holding link 26 (FIGS. 4 and 5) to a releasable generally L-shaped fastening member 28 mountable in an appropriate slot in the upper edge portion of the manway 12*d* and having a pair of link-retaining washer 30 welded in place. The plate 21 has a pair of mounting holes 21*a* similar to holes 20*a* of plate 20 and additionally is provided with a normally plugged hole 21*c* having a removable plug (not shown) for brine sampling purposes. Both plates have small holes 20*b* and 21*b* for passing brine while retaining olives.

The radius of curvature of the spherical portions 12*b* and 14*b* is substantially equal to the diameter of the generally cylindrical portions 12*a* and 14*a*. Neglecting the manway 12*d*, the sump 14*d*, and the half-rib portions 12*c* and 14*c*, the height of each of the spherical portions is less than 20% of its radius of curvature and is substantially equal to the axial length of the generally cylindrical portions 12*a* and 14*a*. Further, neglecting the manway and sump, the overall height of the tank 10 is only about 60% of its diameter.

Turning of the fastening members 28 through a half turn from the position shown in FIG. 4 enables them to be moved through their respective slots at the top edge portion of the manway 12*d*. In this way, the olive retaining plates 20 and 21 can be lowered, reoriented, and removed through the manway.

The generally cylindrical portions 12*a* and 14*a* are tapered for ease of removal from their manufacturing molds.

Various modifications may be made in the structure shown and described without departing from the spirit and scope of the invention.

We claim:

1. A glass fiber reinforced thermosetting resin olive processing tank comprising upper and lower tank halves each including a generally cylindrical portion and a generally spherical portion, the cylindrical portions being joined together and the spherical portions respectively forming the top and bottom of the tank, the upper spherical portion being provided with an upwardly convergent frustoconical manway, and a pair of perforated semicircular olive retaining plates removably mounted in the upper tank half adjacent the lower end of the manway with straight peripheral edge portions thereof abutting each other.

2. A tank as claimed in claim 1 wherein each of the cylindrical portions is flared adjacent the joint to provide half of a strengthening rib for the tank.

3. A tank as claimed in claim 1 wherein the radius of curvature of the spherical portions is substantially equal to the diameter of the cylindrical portions and the height of each of the spherical portions is less than a fifth of its radius of curvature and substantially equal to the height of each of the cylindrical portions.

4. A tank as claimed in claim 1 wherein the lower spherical portion is provided with a sump.

5. A tank as claimed in claim 1 wherein the lower spherical portion is provided with thickened glass mat reinforced bearing portions for cooperative engagement with concrete mounting cradles in an above-ground installation.

6. A tank as claimed in claim 1 including a domed manway cover having a sleeve portion for guiding a float rod.

7. A tank as claimed in claim 1 wherein the junction of the upper spherical portion and the manway includes a sleeve portion and a shoulder portion forming a partial housing for the olive retaining plates.

8. A tank as claimed in claim 1 wherein each semicircular olive retaining plate is provided with a pair of eyebolts and suspended thereby from an upper edge portion of the manway.

* * * * *